United States Patent [19]

De Gennaro

[11] Patent Number: 4,923,013

[45] Date of Patent: May 8, 1990

[54] FIRE SPRINKLER SYSTEM AND AUTOMATIC SHUT-OFF VALVE THEREFOR

[76] Inventor: Sergio K. De Gennaro, 7410 Ridge Blvd., Brooklyn, N.Y. 11207

[21] Appl. No.: 393,596

[22] Filed: Aug. 14, 1989

[51] Int. Cl.[5] ..... A62C 37/10

[52] U.S. Cl. ..... 169/90; 169/37

[58] Field of Search ..... 169/16, 19, 37, 41, 169/43, 54, 90

[56] References Cited

U.S. PATENT DOCUMENTS

| | | | |
|---|---|---|---|
| 260,998 | 7/1882 | Kupka | 169/19 |
| 550,820 | 12/1895 | Burson | 169/19 |
| 598,924 | 2/1898 | Hale | 239/222.17 |
| 1,286,333 | 12/1918 | Johnson | 239/222.17 |
| 2,642,076 | 6/1953 | Tigert et al. | 239/68 |
| 3,757,866 | 9/1973 | Mears et al. | 169/37 |
| 3,812,914 | 5/1974 | Mears | 169/37 |
| 3,911,940 | 10/1975 | Johnson | 169/19 |
| 3,991,829 | 11/1976 | Johnson | 169/19 |
| 4,230,155 | 10/1980 | Frye et al. | 239/68 |
| 4,253,606 | 3/1981 | Johnson | 239/63 |
| 4,335,852 | 6/1982 | Chow | 239/68 |
| 4,638,866 | 1/1987 | Capasso et al. | 169/90 |
| 4,830,117 | 5/1989 | Capasso | 169/90 |

*Primary Examiner*—Sherman D. Basinger
*Assistant Examiner*—Stephen P. Avila
*Attorney, Agent, or Firm*—Gottlieb, Rackman & Reisman

[57] ABSTRACT

An automatic shut-off valve arrangement for a fire sprinkler system includes a set of auxiliary pipe fittings interconnected between the water distribution pipes and the sprinkler heads. Each fitting houses a multi-vane paddle wheel rotatably mounted under an eccentric valve opening normally unobstructed by a movable valve member, and the paddle wheel axle is connected by a gear train to an actuator for the valve member. When water flows from the distribution pipe through the fitting and exits therefrom via the sprinkler head to douse a fire, the paddle wheel rotates rapidly and drives the actuator via the gear train so that the valve member is shifted to close the valve opening and interrupt the flow of water therethrough after a prescribed time interval, thereby minimizing the risk of water damage to the protected premises.

14 Claims, 4 Drawing Sheets

FIRE SPRINKLER SYSTEM AND AUTOMATIC SHUT-OFF VALVE THEREFOR

This invention relates to fire sprinkler systems and to an automatic shut-off valve for the sprinkler heads of such systems.

BACKGROUND OF THE INVENTION

Automatic fire sprinkler systems are currently required by law be incorporated in all new commercial and high rise residential buildings, and in many localities older commercial and residential structures are being required, both for reasons of safety and for entitlement to adequate insurance coverage at reasonable premiums, to be retrofitted with such systems as well. Conventional fire sprinkler systems generally include, within each protected building space such as a room, a loft, a lobby, and the like, a horizontal water distribution pipe which extends across the top of the building space, either above or below the ceiling, and is fed from the water main of the building, and one or more sprinkler heads each of which is connected to the distribution pipe by a respective Tee or branch fitting. Each sprinkler head is provided with a water exit passageway the inlet end of which communicates with the branch fitting and therethrough with the distribution pipe. The outlet end of the water exit passageway is normally sealed by a plug which is retained in place by means of a pair of fusible metal bars anchored at one end to the sprinkler head and bearing at their other ends against the plug, so as to prevent the latter under ordinary circumstances from being ejected from the exit passageway by the pressure of the water in the distribution pipe. Should the temperature in the protected building space rise sufficiently to weaken or even melt the fusible bars, which will occur whenever a fire or a hot smoke condition exists in the protected building space, the water pressure in the distribution pipe causes the plug to be ejected from the exit passageway of the sprinkler head so as to permit the water to flow from the distribution pipe through the sprinkler head into the protected building space to douse the fire or the source of the smoke.

While fire sprinkler systems do have the capacity for minimizing incidences of injury or loss of life as well as damage to and destruction of buildings and their contents by fire, they also have one substantial drawback. That is, once the sprinkler system is set off and the water begins flowing through the sprinkler heads, there is usually no convenient way to interrupt the flow of the water other than by shutting off the main water inlet valve for the building. However, when a fire or hot smoke condition is in progress, even if it has just about been brought under control, the location of the main water inlet valve may be temporarily inaccessible, or the fire fighters and the building personnel may be too preoccupied to attend to the closing of the valve. The result then inevitably is that the continuing flow of water causes the protected building space or spaces where the fire or hot smoke condition existed to become flooded, and some of that water frequently flows into other building spaces on lower floors which per se may have been unaffected by the fire or hot smoke condition. In some cases, therefore, the property damage caused by such excess water is even greater than the damage caused by the fire or smoke condition. The continued flow of water, of course, also represents a needless waste of what, in many areas of the world, is a scarce and extremely valuable commodity.

The existence of the water damage problem, i.e., the possibility that the water damage may exceed the fire damage, has been recognized in the past, and some purported solutions to that problem have heretofore been proposed. See, for example, U.S. Pat. Nos. 260,998, 3,911,940 and 3,991,829. The proposed solutions have, however, generally involved the use of valves controlled by mechanisms which are complicated, costly to produce, maintain and replace, and uncertain of proper operation. Because of their high cost, of course, such valves and their operating mechanisms are not discarded and replaced after each operation but rather (unless they have been totally destroyed by a fire) are reused, which means that irrespective of whether the valves and their operating mechanisms are designed to reset automatically or to be reset manually, they must be individually checked and tested when the main water inlet valve is reopened.

BRIEF DESCRIPTION OF THE INVENTION

It is an object of the present invention, therefore, to provide an automatic fire sprinkler system which has incorporated therein a separate automatic shut-off valve for each sprinkler head connected with the water distribution pipes in the various protected building spaces, with each valve being normally open and including a mechanism operable by water flowing through an associated open sprinkler head for shifting the valve to its closed state after the water flow has continued for a predetermined time interval.

It is another object of the present invention to provide an automatic shut-off valve of the aforesaid type for use with sprinkler heads of a fire sprinkler system, which valves and their operating mechanisms are simple in construction and operation, are easy to install in existing fire sprinkler systems, and are sufficiently inexpensive to manufacture as to make it economically feasible to discard each valve after it has been used once and to replace it by a fresh one.

Generally speaking, the objectives of the present invention are attained by a valve construction which includes a tubular pipe fitting having respective internally and externally threaded nipples at its opposite ends to enable the pipe fitting to be interconnected between a water distribution pipe and a sprinkler head in the protected building space. A multi-vaned paddle wheel is located interiorly of the pipe fitting intermediate its ends and has an axle mounted for rotation about an axis transverse to the pipe fitting. A normally open valve structure is also located interiorly of the pipe fitting intermediate the said one end thereof and the paddle wheel and includes a valve opening disposed eccentrically to the paddle wheel axle and a movable valve member adapted to seal the valve opening, with the valve member being normally in a first position in which it leaves the valve opening unobstructed and being arranged for movement to a second position in which it seals the valve opening. Actuator means are provided for shifting the valve member from its first to its second position, and gear means located exteriorly of the pipe fitting are operatively interconnected between the paddle wheel axle and the actuator means for enabling operation of the latter in response to rotation of the paddle wheel. The arrangement is such, that upon ejection of a sealing plug from the water exit passageway of a sprinkler head by the water pressure in the associated water distribution pipe in the event the temperature in the respective building space rises sufficiently to weaken the fusible metal bar means holding the plug in place, the resultant rotation of the paddle wheel under the force of water flowing from the water distribution pipe and through the pipe fitting into the water exit passageway of the sprinkler head and thence into the protected building space operates the actuator means via the gear means to cause the valve member to move over a predetermined time interval from its first to its second position for interrupting the flow of water into the protected building space once the said predetermined time interval has passed.

BRIEF DESCRIPTION OF THE DRAWINGS

The foregoing and other objects, characteristics and advantages of the present invention will become more clearly understood from the following detailed description thereof when read in conjunction with the accompanying drawings, in which.

Figure 1:
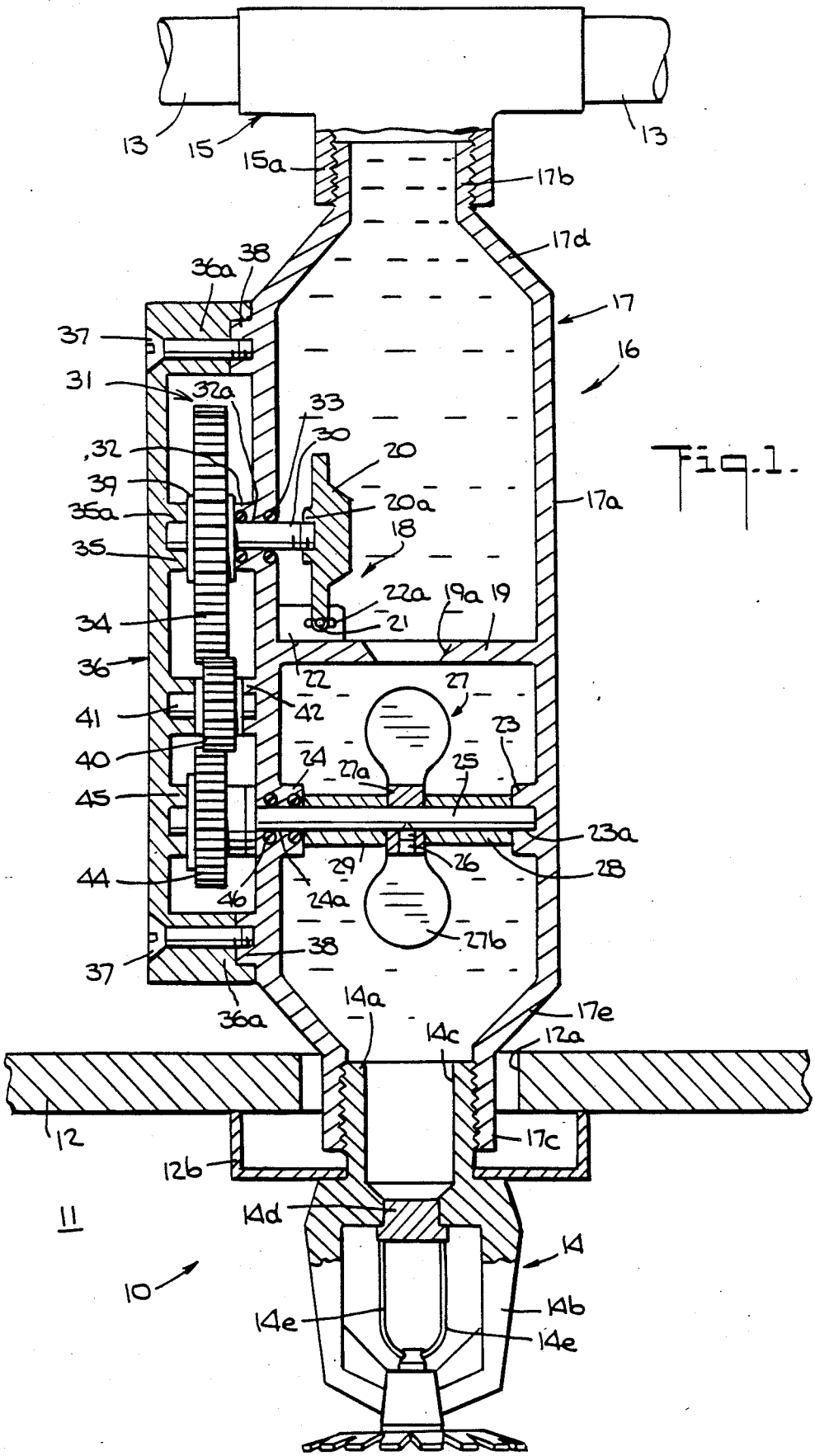
FIG. 1 is a sectional view of a sprinkler head shut-off valve according to the basic principles of the present invention, with the pipe fitting that constitutes the housing of the valve being shown as interconnected between a sprinkler head and a water distribution pipe and with the interior valve member being shown in its open position when the water exit passageway of the sprinkler head is sealed as is the case under normal circumstances.

Referring now to the drawings in greater detail, and in particular to FIG. 1, the usual type of automatic fire sprinkler system 10 currently being provided for a protected building space 11 located below a ceiling 12 conventionally includes (see FIG. 1) a horizontal water distribution pipe 13 fed from the building's water main (not shown) via a riser or standpipe (not shown) and extending across the top of the space 11, and a downwardly directed sprinkler head 14 having an externally threaded nipple 14*a* and connected thereby (this is not shown in FIG. 1 but can be readily visualized) to an internally threaded nipple 15*a* of a Tee or branch fitting 15 connected into the distribution pipe 13. The sprinkler head 14 conventionally has a rigid closed metallic (brass) frame 14*b* of which the nipple 14*a* is an integral extension, the nipple defining an interior passageway 14*c* which is normally open at the inlet end thereof directed toward the distribution pipe 13 and sealed at its outlet or discharge end by a tight-fitting plug 14*d* retained in place by a pair of rigid fusible bars 14*e* each anchored at one end to the sprinkler head frame and bearing at its other end against the plug. When a fire or hot smoke condition occurs in the protected space 11 and the temperature rises beyond a predetermined point, the fusible bars weaken and buckle or even melt, whereupon the plug 14*d* is no longer able to withstand the pressure on the water in the distribution pipe 13 and is ejected thereby from the discharge end of the exit passageway 14*c* to permit the water in the distribution pipe to flow out of the same via the sprinkler head so as to douse the fire or the source of the smoke condition. Once this flow of water has started, however, there is no way to shut it off in the protected space and the flow continues until either a valve in the riser or the main water inlet valve for the entire building can be closed.

It is to avoid this drawback of the known fire sprinkler systems and the potentially disastrous consequences of an inability to interrupt the fire-extinguishing water flow when it is no longer needed, that the present invention contemplates the provision of a separate automatic shut-off valve 16 for each sprinkler head of the fire sprinkler system 10. In accordance with what is currently believed to be the best mode of practicing the present invention, each such shut-off valve 16 includes a tubular pipe fitting 17 having a main body section 17*a* and a pair of respectively externally and internally threaded nipples 17*b* and 17*c* at the opposite ends of the main body section for connecting the pipe fitting 17 to the Tee 15 at one end and to the sprinkler head 14 at the other end. Accordingly, the nipples 17*b* and 17*c* have a standard ½ inch pipe diameter, but for a reason which will become clear as the description proceeds it is preferred that the main body section 17*a* has a relatively larger diameter, preferably 1.0 inch although it could be somewhat greater or smaller than that, with the nipples being connected with the main body section by transition sections 17*d* and 17*e* which are shown as slanted relative to the longitudinal axis of the fitting but may be perpendicular thereto as well. With the pipe fitting so connected, and with its interior in communication with the water distribution pipe 13, water will enter the fitting at its upstream end and fill it down to the downstream end, i.e., to the plug sealing the discharge or outlet end of the water exit passageway 14*c* of the sprinkler head.

Figure 4:
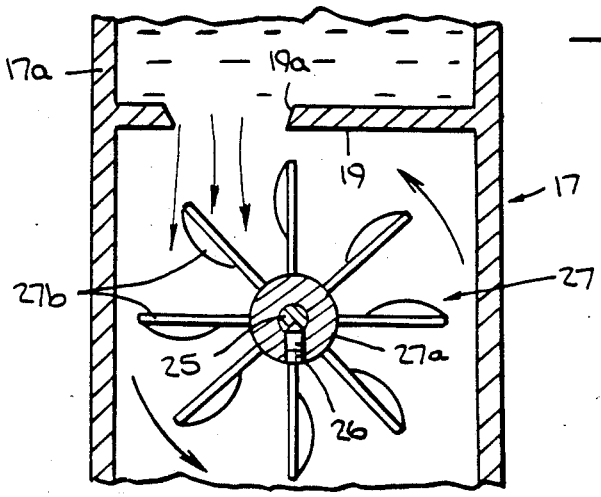
FIG. 4 is a fragmentary sectional view taken along the line 4—4 in FIG. 3.

To enable the passage of water through the shut-off valve 16 to be interrupted, there is provided in the interior of the pipe fitting 17 intermediate its ends a valve structure 18 which includes a transverse valve plate 19 having an eccentrically located valve opening 19*a* therein and a cooperating flap valve member 20 pivotally mounted by pins 21 in a pair of brackets 22 located adjacent the upstream surface of the plate 20. The pins 21 are received, for a purpose to be more fully explained presently, in respective elongated slot-shaped openings 22*a* provided in the brackets 22, by means of which the pins 21 are able to move both angularly and translationally relative to the brackets. Also provided in the interior of the pipe fitting 17 is a pair of preferably diametrically opposed bosses 23 and 24, the former being provided with a blind-ended bore 23*a* and the latter with a through-bore 24*a*. Rotatably journaled in the bosses 23 and 24 is a transverse rod or shaft 25 to the part of which located between the bosses is affixed by means of a set screw 26 the hub 27*a* of a paddle wheel 27 having a plurality of vanes 27*b* (not less than three in number). Spacer sleeves 28 and 29 surrounding the paddle wheel axle serve to prevent axial displacement of the axle and paddle wheel relative to the bosses 23 and 24. The paddle wheel 27 and its axle 25 are preferably located centrally (i.e., in perpendicularly intersecting diametral planes) of the pipe fitting 17, and thus at any point in time only the vanes 27*b* at one side region of the paddle wheel are located under the valve opening 19*a* in the plate 19 (see FIG. 4). It will be understood, therefore, that it is the eccentric location of the valve opening relative to the axle of the paddle wheel which ensures that if water flows dynamically through the valve opening, the paddle wheel will be set into rotation; the same result could, of course, be achieved through other equivalent relationships, e.g., by means of an eccentrically located paddle wheel and a centrally located valve opening.

Figure 3:
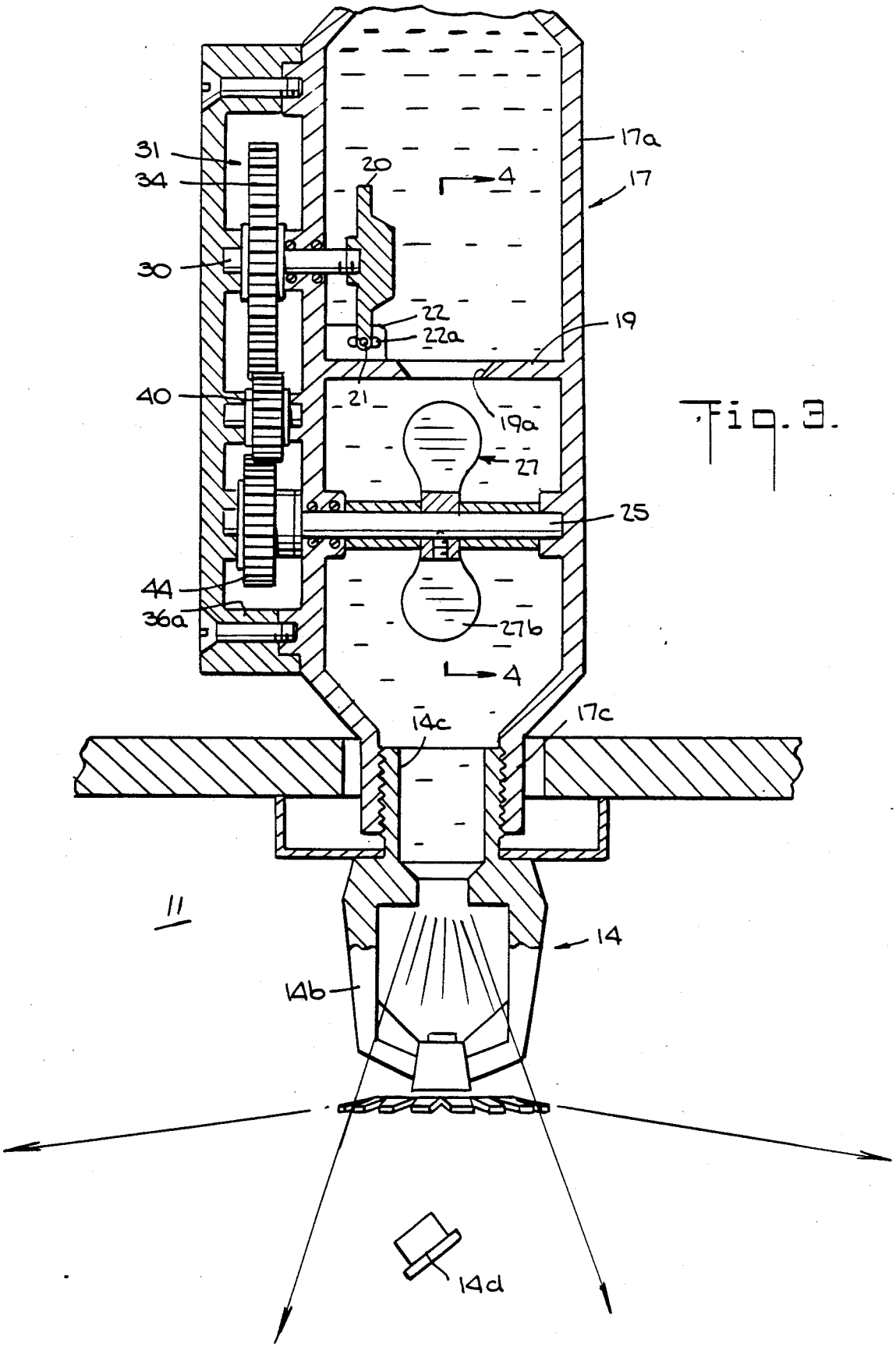
FIG. 3 is a fragmentary sectional view, similar to FIG. 1, of the shut-off valve and the sprinkler head, with the latter being shown just after the sealing plug thereof, in the event of a fire or hot smoke condition, has been ejected from the water exit passageway to permit the water in the pipe fitting to start to flow down into the protected building space.
Figure 5:
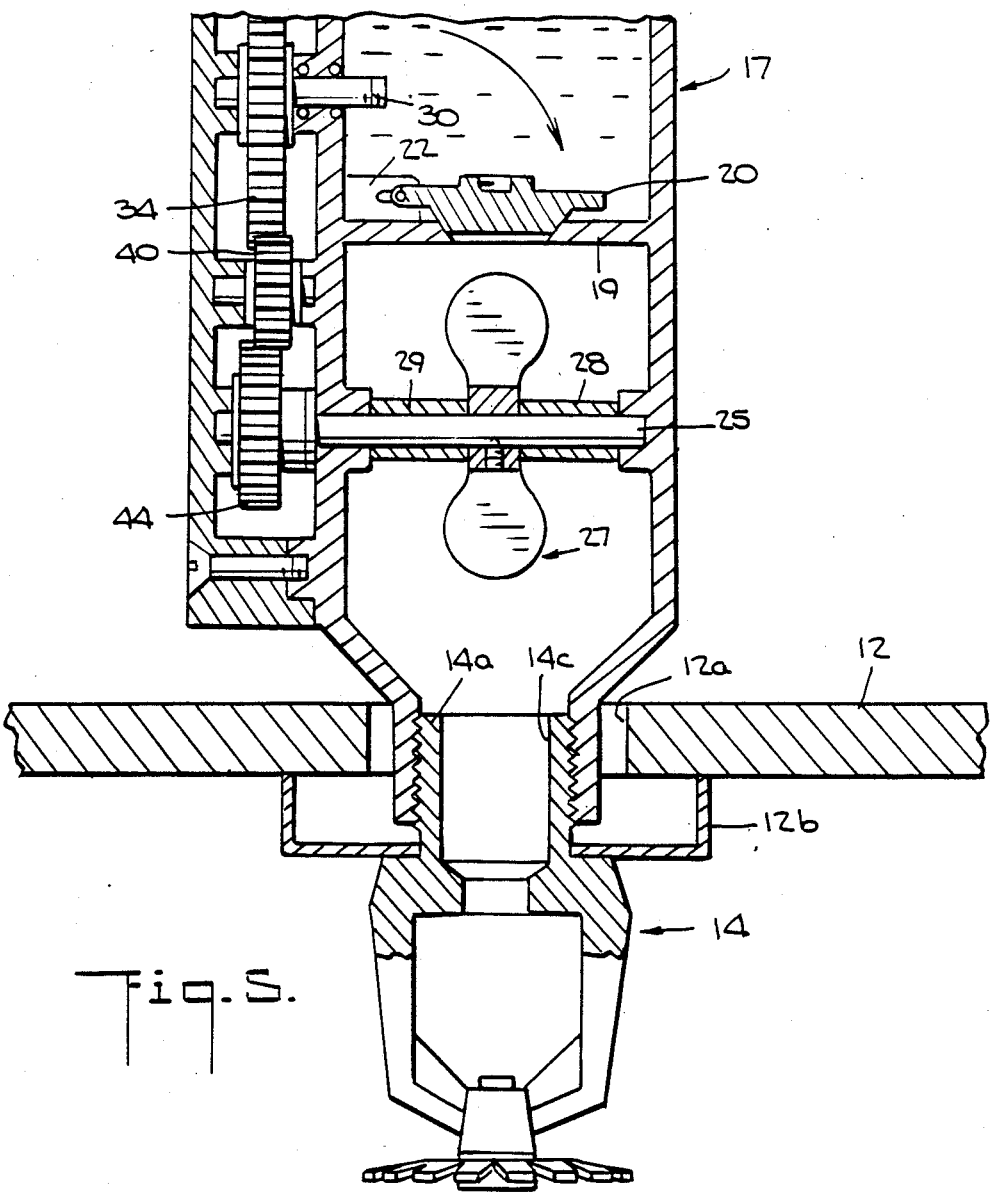
FIG. 5 is a fragmentary sectional view, similar to FIG. 3, of the shut-off valve and the sprinkler head, with the valve member being shown in its closed position to interrupt the flow of water into the protected building space.

The paddle wheel 27 constitutes a part of the means, also including an actuator 39 for the valve member 20 and a gear train 31 interconnecting the actuator and the paddle wheel axle 25, for enabling the valve member to move from its open position shown in FIGS. 1 and 3 to its closed position shown in FIG. 5 in response to the rotation of the paddle wheel. The actuator 30 as shown is a rod rotatably journaled in a bore 32*a* of an exterior boss 32 of the pipe fitting 17, a watertight seal being provided by a pair of O-rings 33 or any other suitable type of gasket arrangement. The end region of the actuator 30 located interiorly of the pipe fitting is threaded and screwed into an internally threaded bore provided in a boss 20*a* on the back side of the valve member 20 in such a way that rotation of the actuator in a counterclockwise sense as viewed from the left in FIG. 1 unscrews the the actuator from the valve member. On its region located exteriorly of the pipe fitting 17 the actuator 30 carries a large spur gear 34, and its outer end region is rotatably journaled in a bore 35*a* of a boss 35 provided on the interior surface of a protective housing or cover member 36 affixed to the gear train-carrying side of the pipe fitting 17 by means of screws or bolts 37 extending horizontally through bushings 36*a* at the top and bottom ends of the cover member and screwed into respective bosses 38 provided on the exterior surface of the pipe fitting 17. The large gear 34, which is slidably separated from the bosses 32 and 35 by suitable washers 39, is in mesh with a small gear 40 the shaft or spindle 41 of which is rotatably journaled in respective bosses 42 and 43 provided on the pipe fitting 17 and the cover member 36. The gear 40 is further in mesh with a gear 44 mounted on the part of the paddle wheel axle 25 which is located exteriorly of the pipe fitting 17 and is rotatably journaled in a boss 45 provided on the cover member 36, a watertight seal between the paddle wheel axle and the boss 24 being provided by a pair of O-rings 46 or any suitable sealing gasket arrangement.

It will be apparent, therefore, that when the paddle wheel is rotating by virtue of water flowing through the opening 19*a* in the plate 19 and impinging against the underlying vanes of the paddle wheel, that motion is transferred to the actuator 30 in an appropriate sense by the gears 44, 40 and 34, albeit at a reduced speed depending on the relative diameters and/or tooth configurations and arrangements of the gears. As the actuator is so operated, it tends to unscrew itself from the boss 20*a* of the valve member 20, which tendency, due to the presence of the slots 22*a* in the pivot brackets 22, is transformed into a translational or linear movement of the valve member 20 away from the actuator 30. Once the threaded end region of the actuator 30 has become fully separated from the valve member, which will occur after passage of a predetermined time interval following the beginning of the rotation of the paddle wheel and depending on the gear transmission ratio, the valve member is free to swing angularly down about the axis of the pivot pins 21 and falls into a position on the valve plate 19 in which it overlies and seals the valve opening 19*a*. As a result thereof, the flow of water through the pipe fitting will then be interrupted. For the purposes of the present invention, the transmission ratio of the gear train 31 is so selected, in consideration of the "fire propagation rate" classification of the protected building space (this is a factor which is a measure of how fire-proof the protected building space is and which is determined basically by the nature of the materials — concrete, steel, wood, etc. — of which the building is constructed and the nature of the materials — paper, plastics, fabrics, paints, sealants, etc. — used for the basic decor of the protected building space), that during the time interval it takes for the actuator 30 to be operated to release the valve member 20, the amount of water that will have passed through the shut-off valve 16 is enough to extinguish the fire or the source of the smoke condition but not enough to flood the protected premises to such an excess as to lead to water damage greater and more widespread than that caused by the fire.

In use, the shut-off valve 16 for each given sprinkler head 14 of the fire sprinkler system 10 is installed as shown in FIG. 1, with the nipple 17*c* of the pipe fitting 17 projecting through a hole 12*a* in the ceiling decoratively covered as at 12*b*, and the pipe fitting 17 is, therefore, filled with water down to the sealed plug 14*d* in the exit passageway 14*c* of the sprinkler head 14. Here it might be noted, in passing, that although the distribution pipe 13 and the shut-off valve 16 are shown as being located above the ceiling 12 of the building space 11, as they most likely would be in, e.g., the normally decorated rooms of either an apartment house or a hotel or an office building, either the valve 16 or both the pipe 13 and the valve 16 could just as well be located below the ceiling, as they most likely would be in, e.g. the normally undecorated rooms of a storage or factory building. In the event the temperature in the space 11 rises to a level sufficient to cause the fusible bars 14*e* of the sprinkler head 14 to become soft or even to melt (for fusible bars of a conventional lead/tin alloy, this would be a temperature of about 180° F.), the pressure of the water in the distribution pipe 13 will then be able to eject the plug 14*d* from the discharge or outlet end of the exit passageway, as shown in FIG. 3, whereupon the water from the pipe 13 will begin to flow dynamically through the valve opening 19*a* and out of the pipe fitting 17 via the sprinkler head, spreading over the protected area as indicated by the arrows and dousing the fire or the source of the hot smoke condition. This will set the paddle wheel 27 into rotation at a speed depending on the rate of flow of the water over it, and that in turn sets the gear 34 and the actuator 30 into rotation, at a much lower speed depending on the transmission ratio of the gear train 31, to cause the valve member 20 to be moved slowly to the right as viewed in FIG. 3. That movement will ultimately culminate in the release of the valve member 20 from the actuator 30 at the end of a predetermined time interval sufficient to have caused the fire to be extinguished, and will permit the valve member to pivot downwardly, under its own weight and the force of the flowing water, into the closed position shown in FIG. 5 where it overlies and seals the valve opening 19*a*. The flow of water out of the sprinkler head 14 will thus be interrupted at the end of the aforesaid time interval, so that the possibility of the water causing additional property damage over and above that caused by the fire or smoke condition is effectively minimized. Thereafter, when the protected building space 11 is being readied for reoccupancy, with the building water main inlet valve (or the appropriate riser valve) still closed, it is merely necessary to connect a fresh shut-off valve 16 and sealed sprinkler head 14 to the distribution pipe 13, discarding the old ones. The main and/or riser valve is then reopened, and the sprinkler system 10 is ready for further use.

Figure 2:
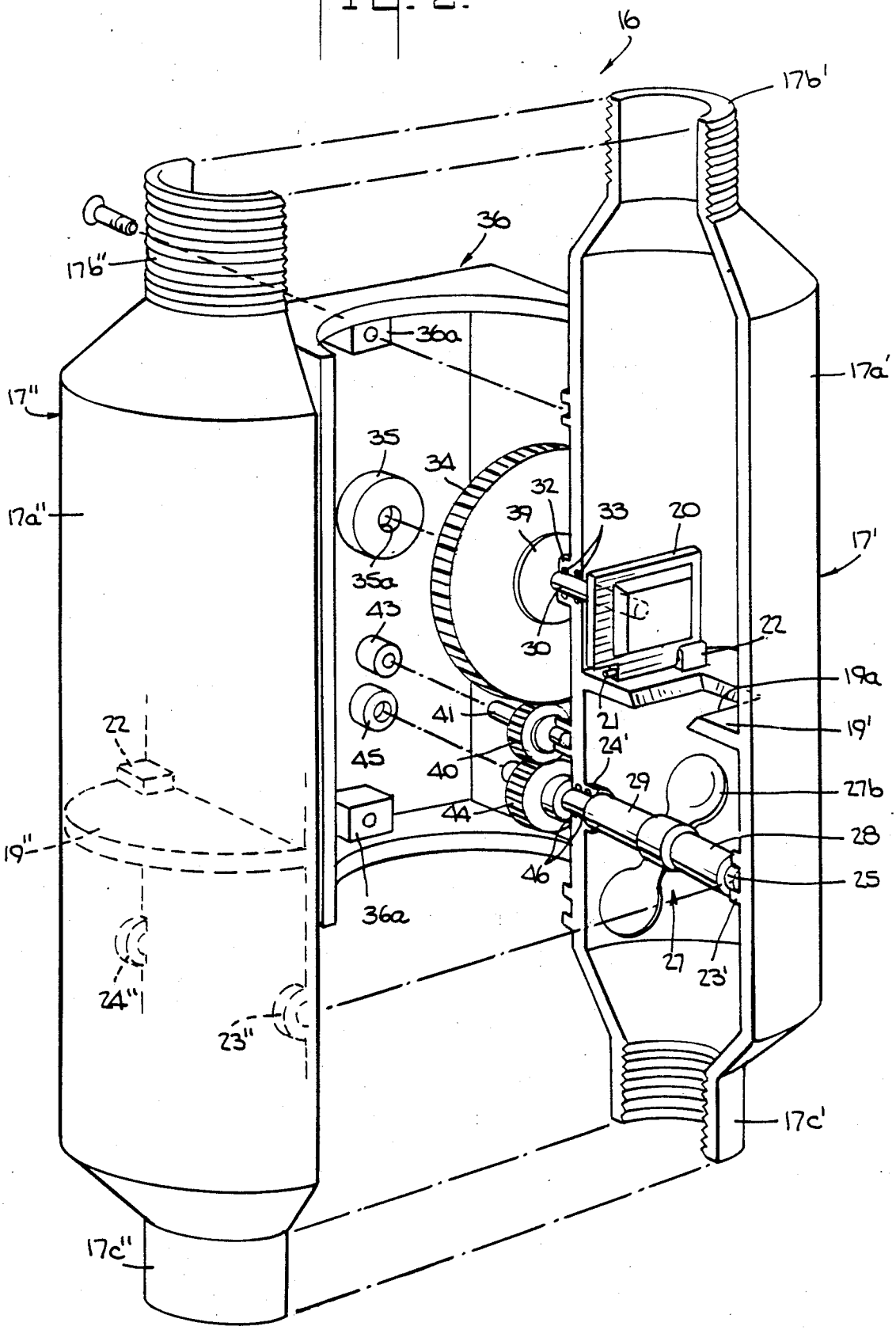
FIG. 2 is an exploded perspective view of the sprinkler head shut-off valve shown in FIG. 1.

It will be apparent from FIG. 2, that the shut-off valve 16 according to the present invention can be easily and inexpensively manufactured, with the pipe fitting 17 being made by ordinary casting techniques in two half sections 17' and 17'' for subsequent assembly by brazing. For ease of recognition, the integral component parts of the two half sections are likewise designated by primed and double-primed versions of the reference numerals used in FIGS. 1 and 3–5. The movable parts, i.e., the valve member 20 and its actuator 30 and the paddle wheel 27 and its axle 25 and spacer sleeves 28–29 are, of course, assembled with the half section 17' before the two half sections are joined to form the pipe fitting 17. The low-cost nature of the shut-off valve 16 thus makes it economically acceptable to simply dispose of it after a single use and replace it with a new valve, since high-cost items such as resettable valve-operating mechanisms and temperature-sensing devices which have been proposed for some known sprinkler shut-off valves are dispensed with.

It will be understood that the foregoing description of a preferred embodiment of the present invention is for purposes of illustration only, and that the various structural and operational features herein disclosed are susceptible to a number of modifications and changes none of which entails any departure from the spirit and scope of the present invention as defined in the hereto appended claims.

I claim:

1. In a fire sprinkler system for a protected building space, said system including a water distribution pipe extending across the top of the building space and fed from the building water main, at least one sprinkler head connected with said water distribution pipe, each said sprinkler head having therein a water exit passageway communicating with said water distribution pipe, a plug sealing said water exit passageway, and rigid fusible metal bar means anchored in said sprinkler head and bearing against said plug to restrain the same under normal circumstances against ejection from said exit passageway by the water pressure in said water distribution pipe;

the improvement comprising:

(a) a respective tubular pipe fitting associated with each sprinkler head and having opposite ends, each said pipe fitting being connected at one end to said water distribution pipe and at its other end to an associated sprinkler head, with the interior of each said pipe fitting being in communication with both said water distribution pipe and said water exit passageway in said associated sprinkler head;

(b) a respective multi-vaned paddle wheel located interiorly of each said pipe fitting intermediate said ends thereof and having an axle mounted for rotation about an axis transverse to said pipe fitting;

(c) a respective valve plate located interiorly of each said pipe fitting intermediate said one end thereof and the associated paddle wheel, each said valve plate having a valve opening therein disposed eccentrically to the associated axle and over the vanes at one side region of the associated paddle wheel;

(d) a respective movable valve member located interiorly of each said pipe fitting and adapted to seal the associated valve opening, each said valve member being normally in a first position relative to the associated valve plate in which it leaves said valve opening thereof unobstructed and being arranged for movement to a second position relative to said associated valve plate in which it seals said valve opening thereof;

(e) respective actuator means for each said valve member and operable for enabling movement of said valve member from said first to said second position thereof; and (f) respective gear means operatively interconnected between each said paddle wheel axle and the associated actuator means for operating the latter in response to rotation of said paddle wheel;

(g) whereby, upon ejection of said plug from said water exit passageway of said at least one sprinkler head by the water pressure in said water distribution pipe in the event the temperature in the protected building space rises sufficiently to weaken said fusible metal bar means of that sprinkler head and cause the same to yield, the resultant rotation of the associated paddle wheel under the force of water flowing from said water distribution pipe into the respective pipe fitting and through said valve opening thereof past said associated paddle wheel and thence through said water exit passageway into said protected building space operates the associated actuator means via the respective gear means to enable said movement of the associated valve member over a predetermined time interval from said first to said second position thereof for interrupting, after said predetermined time interval, the flow of water into said protected building space.

2. A fire sprinkler system as claimed in claim 1, wherein each said paddle wheel and said axle thereof are centrally located relative to the longitudinal axis of said associated pipe fitting, and said valve opening in the associated valve plate is located eccentrically to said paddle wheel axle.

3. A fire sprinkler system as claimed in claim 1, wherein each said valve member is a flap valve member mounted in said associated pipe fitting for pivotal movement between a substantially erect state when in said first position and a substantially horizontal state when in said second position, and cooperating means are provided on each said actuator means and the associated flap valve member for connecting the same to one another when the latter is in said first position and for releasing said flap valve member for movement to said second position when said actuating means are operated by said gear means.

4. A fire sprinkler system as claimed in claim 3, wherein said gear means are constructed and arranged to provide a transmission ratio enabling each said actuator means to release said associated flap valve member at the end of said predetermined time interval.

5. A fire sprinkler system as claimed in claim 4, wherein the respective gear means are located exteriorly of each said pipe fitting.

6. A fire sprinkler system as claimed in claim 1, wherein each said pipe fitting has a main body section provided with respective standard pipe diameter nipples at said opposite ends, one nipple being externally threaded and screwed to an adjunct of said water distribution pipe, and the other nipple being internally threaded and screwed to said sprinkler head.

7. A fire sprinkler system as claimed in claim 6, wherein said main body section of each said pipe fitting has a diameter greater than that of each of the associated nipples.

8. An automatic shut-off valve for a sprinkler head of a fire sprinkler system including a water distribution pipe for said sprinkler head, said shut-off valve comprising:

(a) a tubular pipe fitting having opposite ends, said pipe fitting being adapted to be connected at one end to said water distribution pipe and at its other end to said sprinkler head so as to place the interior of said pipe fitting in communication with both said water distribution pipe and said sprinkler head;

(b) a multi-vaned paddle wheel located interiorly of said pipe fitting intermediate said ends thereof and having an axle mounted for rotation about an axis transverse to said pipe fitting;

(c) a valve plate located interiorly of said pipe fitting intermediate said one end thereof and said paddle wheel, said valve plate having a valve opening therein disposed eccentrically to said axle and over the vanes at one side region of said paddle wheel;

(d) a movable valve member located interiorly of said pipe fitting and adapted to seal said valve opening, said valve member being normally in a first position relative to said valve plate in which it leaves said valve opening unobstructed and being arranged for movement to a second position relative to said valve plate in which it seals said valve opening;

(e) actuator means for said valve member and operable for enabling movement of said valve member from said first to said second position thereof; and (f) gear means operatively interconnected between said paddle wheel and said actuator means for operating the latter in response to rotation of said paddle wheel;

(g) whereby rotation of said paddle wheel under the force of water flowing through said pipe fitting and said valve opening and past said paddle wheel operates said actuator means via said gear means to enable movement of said valve member over a predetermined time interval from said first to said second position thereof for interrupting, after said predetermined time interval, the flow of water through said pipe fitting.

9. A shut-off valve as claimed in claim 8, wherein said paddle wheel and said axle thereof are centrally located relative to the longitudinal axis of said pipe fitting, and said valve opening in said valve plate is located eccentrically to said paddle wheel axle.

10. A shut-off valve as claimed in claim 8, wherein said valve member is a flap valve member mounted in said associated pipe fitting for pivotal movement between a substantially erect state when in said first position and a substantially horizontal state when in said second position, and cooperating means are provided on said actuator means and said flap valve member for connecting the same to one another when the latter is in said first position and for releasing said flap valve member for movement to said second position when said actuating means are operated by said gear means.

11. A shut-off valve as claimed in claim 10, wherein said gear means are constructed and arranged to provide a transmission ratio enabling said actuator means to release said flap valve member at the end of said predetermined time interval.

12. A shut-off valve as claimed in claim 11, wherein said gear means are located exteriorly of said pipe fitting.

13. A shut-off valve as claimed in claim 8, wherein said pipe fitting has a main body section provided with respective standard pipe diameter nipples at said opposite ends, one nipple being externally threaded and adapted to be screwed to an adjunct of said water distribution pipe, and the other nipple being internally threaded and adapted to be screwed to said sprinkler head.

14. A shut-off valve as claimed in claim 13, wherein said main body section of said pipe fitting has a diameter greater than that of each of said nipples.

* * * * *